US011275325B2

(12) United States Patent
Hashikawa et al.

(10) Patent No.: US 11,275,325 B2
(45) Date of Patent: Mar. 15, 2022

(54) IMAGE FORMING APPARATUS INCLUDING A PROCESS CARTRIDGE THAT INCLUDES A DEVELOPING DEVICE

(71) Applicant: Ricoh Company, Ltd., Tokyo (JP)

(72) Inventors: Hotaru Hashikawa, Kanagawa (JP); Yoshihiro Fujiwara, Kanagawa (JP); Nobuo Takami, Kanagawa (JP); Ryusuke Mase, Kanagawa (JP); Kazuki Yogosawa, Tokyo (JP); Tomohiro Kubota, Kanagawa (JP); Naohiro Kawashima, Kanagawa (JP); Yuuki Tsuchiya, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/021,312

(22) Filed: Sep. 15, 2020

(65) Prior Publication Data

US 2021/0080856 A1 Mar. 18, 2021

(30) Foreign Application Priority Data

Sep. 17, 2019 (JP) ..... JP2019-167983

(51) Int. Cl.
*G03G 15/08* (2006.01)

(52) U.S. Cl.
CPC ..... *G03G 15/0808* (2013.01); *G03G 15/0865* (2013.01); *G03G 15/0891* (2013.01)

(58) Field of Classification Search
USPC ..... 399/107
See application file for complete search history.

(56) References Cited

U.S. PATENT DOCUMENTS

2005/0002683 A1* 1/2005 Saito ..... G03G 15/04072 399/107
2016/0313673 A1* 10/2016 Eto ..... G03G 15/0875
2017/0168421 A1 6/2017 Koshizuka et al.
2017/0248870 A1 8/2017 Kubota et al.
(Continued)

FOREIGN PATENT DOCUMENTS

JP 8-152784 6/1996
JP 2000-221766 8/2000
(Continued)

*Primary Examiner* — Quana Grainger
(74) *Attorney, Agent, or Firm* — Xsensus LLP

(57) ABSTRACT

An image forming apparatus includes an image bearer, a rotation shaft, a developing device, and a supply portion. The developing device includes a developing device main portion that rotates around the rotation shaft between a developing position and a retracted position and includes a developer, a developer bearer to face or be away from the image bearer depending on whether the developing device main portion is at the developing position or the retracted position, a replenishment portion having a replenishment port with an opposite surface formed by an arc drawn around the rotation shaft to replenish the developer, and a non-rotating portion. The supply portion has a supply port with an opposite surface formed by an arc drawn around the rotation shaft and facing the opposite surface of the replenishment port. The supply port communicates the replenishment port and supplies the developer to the developing device through the replenishment port.

18 Claims, 7 Drawing Sheets

(56) References Cited

U.S. PATENT DOCUMENTS

| | | | | |
|---|---|---|---|---|
| 2017/0261918 | A1* | 9/2017 | Zensai | G03G 21/1825 |
| 2017/0293257 | A1 | 10/2017 | Ohhira et al. | |
| 2017/0351195 | A1 | 12/2017 | Koshizuka et al. | |
| 2018/0136586 | A1 | 5/2018 | Tsuchiya et al. | |
| 2018/0143568 | A1 | 5/2018 | Ohhira et al. | |
| 2018/0364620 | A1 | 12/2018 | Kubota et al. | |
| 2019/0094758 | A1 | 3/2019 | Kubota et al. | |
| 2019/0250533 | A1 | 8/2019 | Kubota et al. | |
| 2020/0103824 | A1 | 4/2020 | Oshikawa et al. | |
| 2020/0117119 | A1 | 4/2020 | Mase et al. | |
| 2020/0125005 | A1 | 4/2020 | Kubota et al. | |
| 2020/0174400 | A1 | 6/2020 | Kawashima et al. | |

FOREIGN PATENT DOCUMENTS

| | | |
|---|---|---|
| JP | 2011-197071 | 10/2011 |
| JP | 2018-081286 | 5/2018 |

* cited by examiner

IMAGE FORMING APPARATUS INCLUDING A PROCESS CARTRIDGE THAT INCLUDES A DEVELOPING DEVICE

CROSS-REFERENCE TO RELATED APPLICATION

This patent application is based on and claims priority pursuant to 35 U.S.C. § 119 to Japanese Patent Application No. 2019-167983, filed on Sep. 17, 2019 in the Japan Patent Office, the entire disclosure of which is hereby incorporated by reference herein.

BACKGROUND

Technical Field

This disclosure generally relates to an image forming apparatus such as a copier, a printer, a facsimile machine, or a multifunction peripheral (MFP) having at least two of such functions. The image forming apparatus includes a developing device to develop a latent image formed on a surface of an image bearer and may include a process cartridge including the developing device.

Background Art

An image forming apparatus such as a copier or a printer includes a removable developing device. One type of developing device includes a rotatable developing device main portion including a developing roller as a developer bearer. The developing device main portion rotates between a developing position at which the developing roller is close to a photoconductor drum as an image bearer to form an image on the photoconductor drum and a retracted position at which the developing device is away from the photoconductor drum to remove the developing device from the image forming apparatus.

SUMMARY

This specification describes an image forming apparatus that includes an image bearer configured to bear a latent image, a rotation shaft, a developing device, and a supply portion. The developing device is configured to be removably installed in the image forming apparatus and develop the latent image formed on the image bearer. The developing device includes a developing device main portion configured to rotate around the rotation shaft between a developing position and a retracted position. The developing device main portion includes a developer, a developer bearer configured to face the image bearer when the developing device main portion is at the developing position and be away from the image bearer when the developing device main portion is at the retracted position, a replenishment portion having a replenishment port with an opposite surface formed by an arc drawn around the rotation shaft and configured to replenish the developer, and a non-rotating portion. The supply portion has a supply port with an opposite surface formed by an arc drawn around the rotation shaft and facing the opposite surface of the replenishment port. The supply port is configured to communicate the replenishment port and supply the developer to the developing device main portion through the replenishment port.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
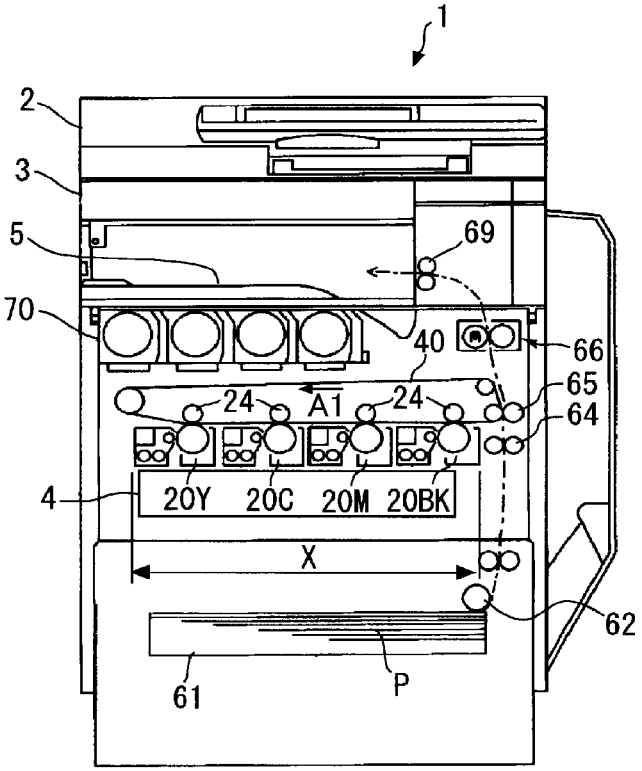
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Embodiments of the present disclosure are described in detail with reference to drawings. Identical reference numerals are assigned to identical components or equivalents and a description of those components is simplified or omitted.

A configuration and operation of an image forming apparatus 1 is described below with reference to FIG. 1.

Figure 2:
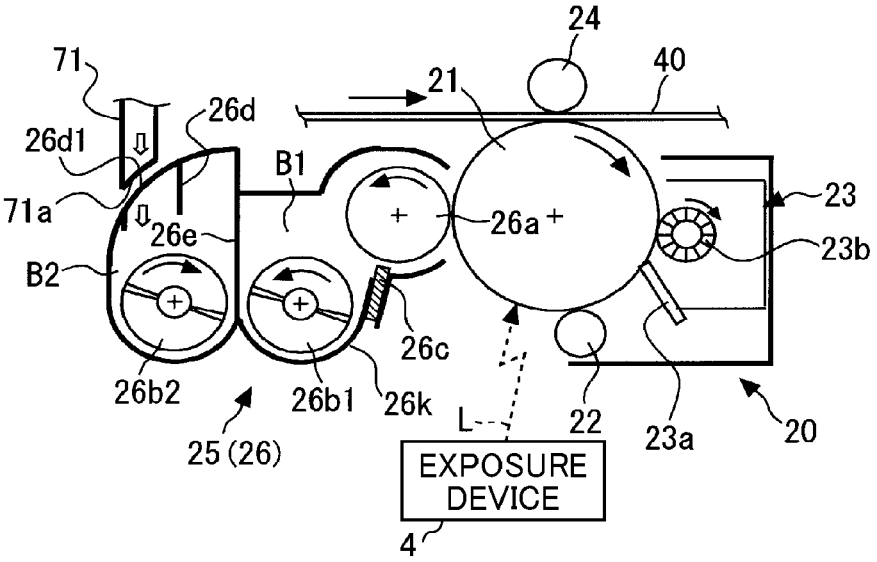
FIG. 2 is a cross-sectional view of an image forming unit of the image forming apparatus in FIG. 1.

The image forming apparatus 1 according to the present embodiment is a tandem multicolor image forming apparatus in which process cartridges 20Y, 20M, 20C, and 20BK are arranged in parallel to each other, facing an intermediate transfer belt 40. In each of the process cartridges 20Y, 20M, 20C, and 20BK, a developing device 25 is installed to face a photoconductor drum 21 as illustrated in FIG. 2.

In FIG. 1, the image forming apparatus 1, which is a color copier in the present embodiment, includes a document conveyance device 2, a scanner 3 as a document reading device, and an exposure device 4 as a writing device. The document conveyance device 2 conveys a document to the scanner 3. The scanner 3 reads image data of the document. The exposure device 4 emits a laser beam based on input image data.

In addition, the image forming apparatus 1 includes the process cartridges 20Y, 20M, 20C, and 20BK to form yellow, magenta, cyan, and black toner images on respective surfaces of the photoconductor drums 21, respectively, and an intermediate transfer belt 40 on which the yellow, magenta, cyan and black toner images are transferred and superimposed.

The image forming apparatus 1 further includes a sheet feeder 61 to accommodate sheets P such as paper sheets, a secondary transfer roller 65 to transfer the toner image formed on the intermediate transfer belt 40 onto the sheet P, a fixing device 66 to fix the unfixed toner image on the sheet P, and toner containers 70 to supply toners of respective colors to the developing devices 25 of the corresponding process cartridges 20Y, 20M, 20C, and 20BK.

Each of the process cartridges 20Y, 20M, 20C, and 20BK includes the photoconductor drum 21 as an image bearer, a charging device 22, and a cleaning device 23, which are united as a single unit as illustrated in FIG. 2. Each of the process cartridges 20Y, 20M, 20C, and 20K, which is expendable, is replaced with a new one when depleted in a body of the image forming apparatus 1.

In each of the process cartridges 20Y, 20M, 20C, and 20BK, the developing device 25 is installed to face the photoconductor drum 21. The developing device 25 is expendable and replaced with a new one when depleted in the body of the image forming apparatus 1. An operator can independently perform an installation and removal operation of the developing device 25 with respect to the body of the image forming apparatus 1 and an installation and removal operation of the process cartridges 20Y, 20M, 20C, and 20BK with respect to the body of the image forming apparatus 1 as different operations. In the process cartridges 20Y, 20M, 20C, and 20BK, yellow, magenta, cyan, and black toner images are formed on the respective photoconductor drums 21 as the image bearers.

The following is a description of image forming processes in the image forming apparatus 1 to form a color toner image on a sheet P.

A conveyance roller of the document conveyance device 2 conveys a document on a document table onto a platen (exposure glass) of the scanner 3. The scanner 3 optically scans image data for the document on the platen.

The yellow, magenta, cyan, and black image data are transmitted to the exposure device 4. The exposure device 4 irradiates the photoconductor drums 21 (see FIG. 2) of the corresponding process cartridges 20Y, 20M, 20C, and 20BK with laser beams (as exposure light) L based on the yellow, magenta, cyan, and black image data, respectively.

Each of the four photoconductor drums 21 rotates clockwise in FIGS. 1 and 2. The surface of the photoconductor drum 21 is uniformly charged at a position where the photoconductor drum 21 faces the charging device 22 that is a charging roller, which is referred to as a charging process. Thus, the surface of the photoconductor drum 21 is charged to a certain potential.

When the charged surface of the photoconductor drum 21 reaches a position to receive the laser beam L emitted from the exposure device 4, an electrostatic latent image based on the image data is formed on the surface of the photoconductor drum 21, which is referred to as an exposure process.

The laser beam L corresponding to the yellow image data is directed to the surface of photoconductor drum 21 in the process cartridge 20Y, which is the first from the left in FIG. 1 among the four process cartridges 20Y, 20M, 20C, and 20BK. A polygon mirror that rotates at high velocity deflects the laser beam L for yellow along the rotation axis direction of the photoconductor drum 21 (i.e., the main-scanning direction) so that the laser beam L scans the surface of the photoconductor drum 21. Thus, an electrostatic latent image for yellow is formed on the surface of the photoconductor drum 21 charged by the charging device 22.

Similarly, the laser beam L corresponding to the cyan image data is directed to the surface of the photoconductor drum 21 in the second process cartridge 20C from the left in FIG. 1, thus forming an electrostatic latent image for cyan on the surface of the photoconductor drum 21. The laser beam L corresponding to the magenta image data is directed to the surface of the photoconductor drum 21 in the third process cartridge 20M from the left in FIG. 1, thus forming an electrostatic latent image for magenta on the photoconductor drum 21. The laser beam L corresponding to the black image data is directed to the surface of the photoconductor drum 21 in the fourth process cartridge 20K from the left in FIG. 1, thus forming an electrostatic latent image for black on the photoconductor drum 21.

Then, the surface of the photoconductor drum 21 having the electrostatic latent image reaches a position opposite the developing device main portion 26. The developing device main portion 26 deposits toner of each color onto the surface of the photoconductor drum 21 and develops the electrostatic latent image on the photoconductor drum 21 into a toner image, which is referred to as a development process.

After the development process, the surfaces of the photoconductor drums 21 reach positions facing the intermediate transfer belt 40. The primary transfer rollers 24 are disposed at the positions where the photoconductor drums 21 face the intermediate transfer belt 40 and in contact with an inner circumferential surface of the intermediate transfer belt 40, respectively. At the positions of the primary transfer rollers 24, the toner images on the photoconductor drums 21 are transferred to and superimposed on the intermediate transfer belt 40, forming a multicolor toner image thereon, which is referred to as a primary transfer process.

After the primary transfer process, the surface of the photoconductor drum 21 reaches a position opposite the cleaning device 23. The cleaning device 23 collects untransferred toner remaining on the photoconductor drum 21, which is referred to as a cleaning process.

Subsequently, a residual potential of the surface of the photoconductor drum 21 is removed at a position opposite the discharger, and a series of image forming processes performed on the photoconductor drum 21 is completed.

Meanwhile, the surface of the intermediate transfer belt 40, onto which the single-color toner images on the photoconductor drums 21 are superimposed, moves in the direction indicated by arrow A1 in FIG. 1 and reaches a position opposite the secondary transfer roller 65. The secondary transfer roller 65 secondarily transfers the multicolor toner image on the intermediate transfer belt 40 to the sheet P, which is referred to as a secondary transfer process.

After the secondary transfer process, the surface of the intermediate transfer belt 40 reaches a position opposite a belt cleaning device. The belt cleaning device collects untransferred toner on the intermediate transfer belt 40 to complete a series of transfer processes on the intermediate transfer belt 40.

The sheet P is conveyed to the position of the secondary transfer roller 65, via the registration roller pair 64 from the sheet feeder 61.

Specifically, a sheet feed roller 62 feeds the sheet P from the top of multiple sheets P accommodated in the sheet feeder 61, and the sheet P is conveyed to a registration roller pair 64 through a sheet feed path. The sheet P that has reached the registration roller pair 64 is conveyed toward the position of the secondary transfer roller 65, timed to coincide with the arrival of the multicolor toner image on the intermediate transfer belt 40.

Subsequently, the sheet P, onto which the multicolor image is transferred, is conveyed to the fixing device 66. The fixing device 66 includes a fixing roller and a pressure roller pressing against each other. In a nip between the fixing roller and the pressure roller, the multicolor image is fixed on the sheet P.

After the above-described fixing process, an output roller pair 69 ejects the sheet P as an output image to the exterior of the image forming apparatus 1, and the ejected sheet P is stacked on an output tray 5 to complete a series of image forming processes.

Next, with reference to FIGS. 2 and 3, the image forming units of the image forming apparatus 1 are described in detail below.

The four image forming units in the body of the image forming apparatus 1 have a similar configuration except the color of the toner used in the image forming processes. Therefore, parts of the image forming unit such as the process cartridge and the developing device are illustrated without suffixes Y, M, C, and K, which denote the color of the toner, in the drawings.

As illustrated in FIG. 2, the process cartridge 20 mainly includes the photoconductor drum 21 as the image bearer, the charging device 22, and the cleaning device 23, which are stored in a case of the process cartridge 20 as a single unit. The photoconductor drum 21 is an organic photoconductor designed to be charged with a negative polarity and includes a photosensitive layer formed on a drum-shaped conductive support. As illustrated in FIG. 3, the photoconductor drum 21 is rotatably held by holders 21*a* that are also parts of the case of the process cartridge 20.

The charging device 22 is the charging roller including a conductive core and an elastic layer of moderate resistivity coated on the conductive core. A power supply applies a predetermined voltage to the charging device 22 that is the charging roller, and the charging device 22 uniformly charges the surface of the photoconductor drum 21 opposite the charging device 22.

The cleaning device 23 includes a cleaning blade 23*a* and a cleaning roller 23*b* that contact the photoconductor drum 21. For example, the cleaning blade 25*a* is made of rubber, such as urethane rubber, and contacts the surface of the photoconductor drum 21 at a predetermined angle with a predetermined pressure. The cleaning roller 25*b* is a brush roller in which brush bristles are provided around a core.

Figure 3:
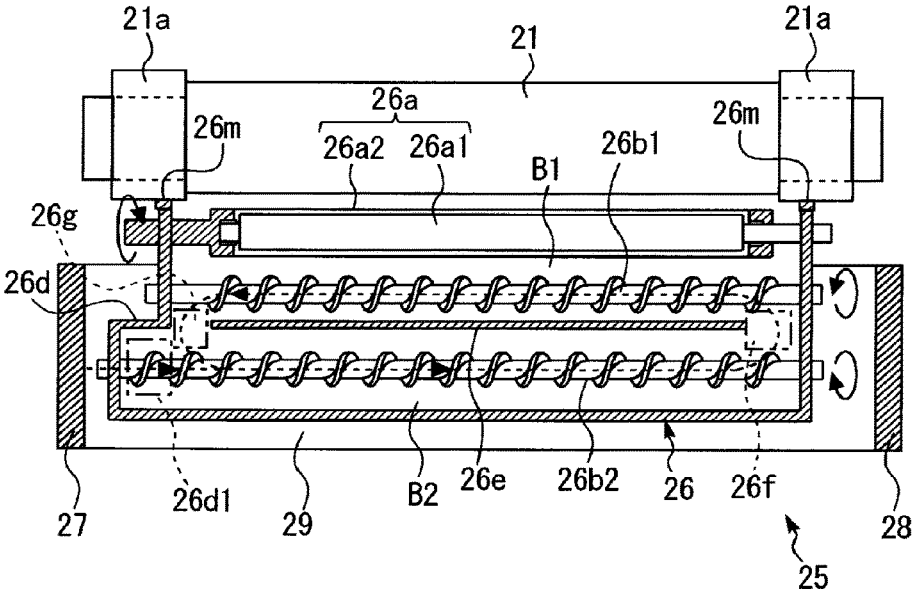
FIG. 3 is a schematic cross-sectional view illustrating a developing device and a photoconductor drum of the image forming unit in FIG. 2 as viewed along a longitudinal direction of the developing device.

As illustrated in FIGS. 2 and 3, the developing device 25 mainly includes the developing device main portion 26, two face plates that are a rear face plate 27 and a front face plate 28, and a base 29 as a connecting member.

The developing device main portion 26 mainly includes a developing roller 26*a* as a developer bearer, a first conveying screw 26*b*1 as a first conveyor facing the developing roller 26*a*, a partition 26*e*, a second conveying screw 26*b*2 as a second conveyor facing the first conveying screw 26*b*1 via the partition 26*e*, and a doctor blade 26*c* as a developer regulator facing the developing roller 26*a* to regulate an amount of developer borne on the developing roller 26*a*.

The developing device main portion 26 stores a two-component developer including carrier and toner.

Figure 4A:
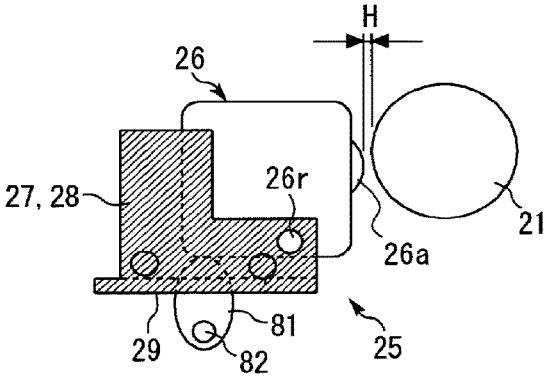
FIG. 4A is an explanatory view illustrating the developing device when a developing device main portion of the developing device is located at a developing position.

The developing roller 26*a* is opposed to the photoconductor drum 21 with a small gap H as illustrated in FIG. 4A, thereby forming a developing range. As illustrated in FIG. 3, the developing roller 26*a* includes stationary magnets 26*a*1 inside and a sleeve 26*a*2 that rotates around the magnets 26*a*1. The magnets 26*a*1 generate multiple poles (magnetic poles) around the outer circumferential surface of the developing roller 26*a*.

The first conveying screw 26*b*1 and the second conveying screw 26*b*2 as conveyors convey the developer stored in the developing device main portion 26 in the longitudinal direction of the developing device main portion 26, thereby establishing a circulation path indicated by the dashed arrow in FIG. 3. That is, the first conveying screw 26*b*1 establishes a first conveyance path B1, and the second conveying screw 26*b*2 establishes a second conveyance path B2. The circulation path of the developer is composed of the first conveyance path B1 and the second conveyance path B2. The partition 26*e* is an inner wall and separates the first conveyance path B1 from the second conveyance path B2, and the first and second conveyance paths B1 and B2 communicate with each other via first and second communication openings 26*f* and 26*g* disposed at both ends of the first and second conveyance paths B1 and B2 in the longitudinal direction. Specifically, with reference to FIG. 3, in a conveyance direction of the developer, an upstream end of the first conveyance path B1 communicates with a downstream end of the second conveyance path B2 via the first communication opening 26*f* Additionally, in the conveyance direction of the developer, a downstream end of the first conveyance path B1 communicates with an upstream end of the second conveyance path B2 via the second communication opening 26*g*. That is, the partition 26*e* is disposed along the circulation path in the longitudinal direction except both ends of the circulation path.

The first conveying screw 26*b*1 in the first conveyance path B1 is opposite the developing roller 26*a*, and the second conveying screw 26*b*2 in the second conveyance path B2 is opposite the first conveying screw 26*b*1 in the first conveyance path B1 via the partition 26*e*. The first conveying screw 26*b*1 supplies developer to the developing roller 26*a* and collects the developer that separates from the developing roller 26*a* after the development process while conveying the developer in the longitudinal direction of the developing device main portion 26.

After the development process, the second conveying screw 26*b*2 stirs and mixes the developer conveyed from the first conveyance path B1 with a fresh toner supplied from a replenishment port 26*d*1 while conveying the developer in the longitudinal direction of the developing device main portion 26.

In the present embodiment, the first and second conveying screws 26*b*1 and 26*b*2 as the conveyors are horizontally arranged in parallel. Each of the first and second conveying screws 26*b*1 and 26*b*2 includes a shaft and a screw blade wound around the shaft.

A further detailed description is given of the image forming processes described above, focusing on the development process.

The developing roller 26*a* rotates counterclockwise in FIG. 2. As illustrated in FIGS. 2 and 3, the first conveying screw 26*b*1 and the second conveying screw 26*b*2 are disposed facing each other with the partition 26*e* interposed therebetween and rotate in directions indicated by arrows in FIGS. 2 and 3. Toner (developer) is supplied from the toner container 70 to the replenishment port 26*d*1 via a main body toner supply tube 71 as a supply portion. As the first conveying screw 26*b*1 and the second conveying screw 26*b*2 rotate in the respective directions in FIG. 2, the developer stored in the developing device main portion 26 circulates in the longitudinal direction of the developing device main portion 26, that is, a direction indicated by the dashed arrow in FIG. 3, and the supplied toner (developer) is stirred and mixed with the developer circulating.

Stirring the developer causes the toner to be charged by friction with carrier in the developer and electrostatically attracted to the carrier. A magnetic force is generated on the developing roller 26*a* to scoop up the carrier. The magnetic force that is called as a developer scooping pole scoop up the carrier with the toner on the developing roller 26*a*. The developer borne on the developing roller 26*a* is conveyed in the counterclockwise direction indicated by arrow in FIG. 2 to a position opposite the doctor blade 26*c*. The doctor blade 26*c* adjusts an amount of the developer on the developing roller 26*a* at the position. Subsequently, rotation of the developing roller 26*a* conveys the developer to the developing range in which the developing roller 26*a* faces the photoconductor drum 21. In the developing range, a predetermined voltage as a developing bias is applied to the developing roller 26*a* by a development power supply, and a surface potential as a latent image potential is formed on the photoconductor drum 21 in the charging process and the exposure process. The developing bias and the latent image potential form an electric field in the developing range. The electric field formed in the developing range deposits toner on the electrostatic latent image formed on the photoconductor drum 21. As the sleeve 26*a*2 rotates, the developer remaining on the developing roller 26*a* reaches above the first conveyance path B1 and separates from the developing roller 26*a*.

It is to be noted that, as the toner is consumed in the developing device main portion 26, the new toner contained in the toner container 70 is replenished appropriately to the developing device main portion 26 via the replenishment port 26*d*1 of a replenishment portion 26*d*. The toner consumption in the developing device main portion 26 is detected by a toner concentration sensor that magnetically detects a toner concentration in the developer (i.e., a ratio of toner to the developer) in the developing device main portion 26.

The replenishment port 26*d*1 is disposed above an end of the second conveying screw 26*b*2 in the second conveyance path B2 in the longitudinal direction that is the left and right direction in FIG. 3.

The configuration and operation of the developing device 25 according to the present embodiment are described in further detail below.

As described above, the developing device 25 according to the present embodiment is installable in and removable from the body of the image forming apparatus 1. Specifically, the developing device 25 in the present embodiment is installed in and removed from the body of the image forming apparatus 1 in an installation and removal direction that is the longitudinal direction of the developing device 25, the direction perpendicular to the surface of the sheet on which FIGS. 1 and 2 are drawn, and a lateral direction in FIG. 3. As illustrated in FIGS. 3 to 5, the developing device 25 in the present embodiment mainly includes the developing device main portion 26, two face plates that are the rear face plate 27 and the front face plate 28, and the base 29 as the connecting member.

The developing device main portion 26 includes the developing roller 26*a* as the developer bearer facing the photoconductor drum 21 as the image bearer, the first conveying screw 26*b*1, the second conveying screw 26*b*2, and the doctor blade 26*c*. The developing device 25 is integrally configured by the developing device main portion 26, the two face plates 27 and 28, and the base 29 and installed in and removed from the body of the image forming apparatus 1. In the present embodiment, the developing device 25 is installed in and removed from the body of the image forming apparatus 1 in the installation and removal direction that is the longitudinal direction of the developing device 25. Specifically, the developing device 25 is installed in the image forming apparatus 1 in a direction indicated by arrow in FIG. 5 and is removed from the image forming apparatus 1 in a direction opposite the direction indicated by arrow in FIG. 5.

Both ends of the developing device main portion 26 in the longitudinal direction of the developing device main portion 26 is arranged between the two face plates 27 and 28 as positioners. The longitudinal direction is a direction substantially coincident with the rotation axis direction of the photoconductor drum 21, the lateral directions in FIGS. 3 and 5, and a direction perpendicular to the surface of the sheet on which FIG. 4 is drawn.

Specifically, the rear face plate 27 is disposed behind the developing device main portion 26 in a mounting direction of the developing device main portion 26 that is a left side in FIG. 5, and the front face plate 28 is disposed in front of the developing device main portion 26 in the mounting direction that is a right side in FIG. 5. As a result, the developing device main portion 26 is interposed between the rear face plate 27 and the front face plate 28.

The two face plates 27 and 28 are respectively positioned in the body of the image forming apparatus 1 not to rotate. That is, the two face plates 27 and 28 each function as a non-rotating portion in the developing device 25, that is, the non-rotating portion different from the rotatable developing device main portion 26. Specifically, with reference to FIG. 5, when the developing device 25 is installed in the body of the image forming apparatus 1, two positioning pins 93 fixed to a rear side plate 91 of the body of the image forming apparatus 1 and arranged side by side in a direction perpendicular to the sheet surface in FIG. 5 are inserted into positioning holes of the rear face plate 27 to position the rear face plate 27 with respect to the rear side plate 91 of the body of the image forming apparatus 1.

Similarly, when the developing device 25 is installed in the body of the image forming apparatus 1, two positioning pins 94 fixed to a front side plate 92 of the body of the image forming apparatus 1 and arranged side by side in a direction perpendicular to the sheet surface in FIG. 5 are inserted into positioning holes of the front face plate 28 to position the front face plate 28 with respect to the front side plate 92 of the body of the image forming apparatus 1. The front side plate 92 of the body of the image forming apparatus 1 has an opening to avoid an interference between the front side plate 92 and the developing device 25 so that the developing device 25 can be installed in and removed from the body of the image forming apparatus 1.

The base 29 are coupled to the two face plates 27 and 28 to bridge between the two face plates 27 and 28. Specifically, in the present embodiment, the base 29 and the two face plates 27, 28 are made of a resin material having high mechanical strength. A bottom portion of the rear face plate 27 is coupled to one end of the base 29 in the longitudinal direction of the base 29, and a bottom portion of the front face plate 28 is coupled to the other end of the base 29 in the longitudinal direction.

Providing the base 29 as described above can reduce trouble caused by twist in the two face plates 27 and 28 even when the developing device main portion 26 is configured to be rotatable between the two face plates 27 and 28 as described below. The two face plates 27 and 28 and the base 29 may be made as separate components and coupled by screw fastening. Alternatively, the two face plates 27 and 28 and the base 29 may be integrally formed as one component. The two face plates 27 and 28 and the base 29 integrally formed can reduce the number of parts and the man-hour for assembly and easily set the twist strength of the two face plates 27 and 28 stronger.

As illustrated in FIG. 4, the developing device main portion 26 is configured to be rotatable around a rotation shaft 26*r* in the developing device 25.

Figure 4B:
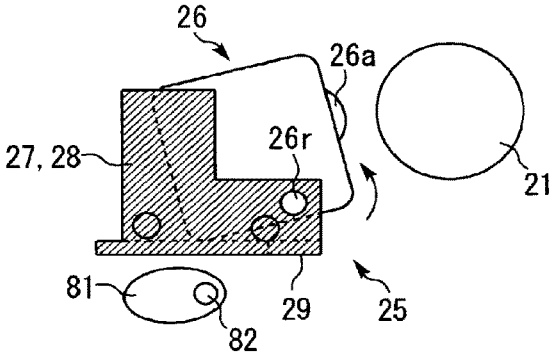
FIG. 4B is an explanatory view illustrating the developing device when the developing device main portion is located at a retracted position.
Figure 5:
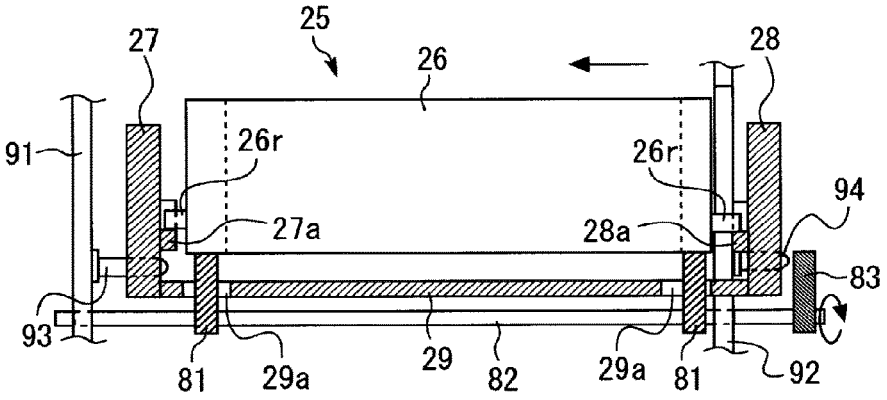
FIG. 5 is an explanatory view illustrating a configuration of the developing device and a part of the image forming apparatus near the developing device along the longitudinal direction of the developing device.

Specifically, the developing device main portion 26 is interposed between the rear face plate 27 and the front face plate 28 and disposed to be rotatable around the rotation shaft 26*r* between a developing position at which the developing roller 26*a* as the developer bearer faces the photoconductor drum 21 as the image bearer with a predetermined gap H, that is, a rotational position illustrated in FIG. 4A, and a retracted position in which the developing roller 26*a* is away from the photoconductor drum 21, that is, a rotational position illustrated in FIG. 4B.

The developing position (a first position) of the developing device main portion 26 illustrated in FIG. 4A is the rotational position at which the developing device main portion 26 can perform the general development process described above.

In contrast, the retracted position (a second position) of the developing device main portion 26 illustrated in FIG. 4B is the rotational position at which the developing device main portion 26 is sufficiently separated from the photoconductor drum 21 (the process cartridge 20). Therefore, at the retracted position, the developing device main portion 26 and the photoconductor drum 21 (the process cartridge 20) do not interfere each other even when the developing device 25 is moved in the longitudinal direction to be installed in or removed from the body of the image forming apparatus 1 that is installed in the photoconductor drum 21 (the process cartridge 20), and even when the photoconductor drum 21 (the process cartridge 20) is moved in the longitudinal direction to be installed in or removed from the body of the image forming apparatus 1 that is installed in the developing device 25. When the developing device main portion 26 is positioned at the retracted position, the developing device main portion 26 does not perform the general development process.

In the present embodiment, as illustrated in FIG. 4, the rotation shaft 26*r* is positioned obliquely below the rotation axis of the photoconductor drum 21 when the developing device 25 is installed in the body of the image forming apparatus 1. In addition, the rotation shaft 26*r* is positioned at a height position close to the bottom of the developing device main portion 26. The above-described configuration causes the developing device main portion 26 to smoothly rotate between the developing position and the retracted position.

Referring to FIG. 5, the rear face plate 27 includes a U-shaped receiving portion 27*a* on the inner surface in the longitudinal direction of the developing device 25, and the front face plate 28 includes a U-shaped receiving portion 28*a* on the inner surface in the longitudinal direction. On the other hand, the developing device main portion 26 includes the rotation shaft 26*r* that projects toward outside in the longitudinal direction from side plates of the exterior of the developing device main portion 26, that is, the side plate facing the rear face plate 27 and the side plate facing the front face plate 28. The rotation shaft 26*r* of the developing device main portion 26 is fitted to the receiving portions 27*a* and 28*a* so that the developing device main portion 26 hangs between the rear face plate 27 and the front face plate 28 and is set to be rotatable.

In the present embodiment, when the developing device 25 is installed in the body of the image forming apparatus 1, a pushing mechanism (including cams 81 and a cam shaft 82 described below) set in the body of the image forming apparatus 1 pushes the developing device main portion 26 to rotate the developing device main portion 26 from the retracted position as illustrated in FIG. 4B to the developing position as illustrated in FIG. 4A and releases pushing the developing device main portion 26 to rotate the developing device main portion 26 from the developing position illustrated in FIG. 4A to the retracted position illustrated in FIG. 4B.

Specifically, with reference to FIG. 5, the pushing mechanism includes two cams 81 and a cam shaft 82. The two side plates 91 and 92 of the body of the image forming apparatus 1 rotatably support the cam shaft 82. The two cams 81 are disposed at positions separated from each other in the longitudinal direction (for example, both end portions). An operation lever 83 rotatable together with the cam shaft 82 and the cams 81 are disposed at the front end of the can shaft 82 in the mounting direction that is a right end of the can shaft 82 in FIG. 5. Therefore, the operation of the operation lever 83 disposed at the front side in the mounting direction in the body of the image forming apparatus 1 moves the pushing mechanism (the cams 81 and the cam shaft 82). Opening a cover of the body of the image forming apparatus 1 exposes the operation lever 83 to the front side in the mounting direction and enables an operator (a user) to operate and rotate the operation lever 83.

Specifically, when the developing device main portion 26 is at the retracted position illustrated in FIG. 4B, the operator operates and turns the operation lever 83 to rotate the cams 81 (and the cam shaft 82) clockwise in FIG. 4, and the cams 81 push the developing device main portion 26 to rotate the developing device main portion 26 clockwise in FIG. 4 about the rotation shaft 26*r*. As a result, the developing device main portion 26 is located at the developing position illustrated in FIG. 4A.

At the developing position, projections 26*m* disposed on a case of the developing device main portion 26 (see FIG. 3) abuts the holders 21*a* that rotatably hold the photoconductor drum 21 to position the developing device main portion 26 (to form the desired gap H). In other words, the developing device main portion 26 includes the projections 26*m* that contact the holders 21*a* to position the rotational position of the developing device main portion 26 when the developing device main portion 26 rotates to the developing position. The holders 21*a* are disposed at both end portions of the process cartridge 20 in the rotation axis direction of the photoconductor drum 21, and the projections 26*m* are also disposed at both end portions of the developing device main portion 26 in the longitudinal direction of the developing device main portion 26. The holders 21*a* and the projections 26*m* are disposed outside an effective image area. The cam 81 is arranged to be able to contact a point on the bottom portion of the developing device main portion 26, and the point is farther from the photoconductor drum 21 than the rotation shaft 26*r*.

In contrast, when the developing device main portion 26 is at the developing position illustrated in FIG. 4A, the operator operates and turns the operation lever 83 to rotate the cams 81 (and the cam shaft 82) counterclockwise in FIG. 4, and the cams 81 releases pushing the developing device main portion 26 to rotate the developing device main portion 26 counterclockwise in FIG. 4 about the rotation shaft 26*r*. As a result, the developing device main portion 26 is located at the retracted position illustrated in FIG. 4B.

When the pushing mechanism (including the cams 81 and the cam shaft 82) releases pushing the developing device main portion 26, the weight of the developing device main portion 26 rotates the developing device main portion 26 from the developing position to the retracted position. Specifically, the center of gravity of the developing device main portion 26 is farther from the photoconductor drum 21 than the rotation shaft 26*r*. The above-described configuration in which the weight of the developing device main portion 26 rotates the developing device main portion 26 to the retracted position when the pushing mechanism (including the cams 81 and the cam shaft 82) releases pushing the developing device main portion 26 can reduce the size and cost of the device as compared with a configuration including a component that rotates the developing device main portion to the retracted position.

In the present embodiment, the developing device main portion 26 contacts the base 29 to prevent the developing device main portion 26 from rotating too much in the counterclockwise direction in FIG. 4, that is, the base 29 functions as a stopper. The stopper is not limited to the base 29, and another component may function as the stopper.

The pushing mechanism (including the cams 81 and the cam shaft 82) configured and operating as described above is arranged so that the developing device 25 can be installed in and removed from the image forming apparatus 1.

In particular, in the present embodiment, the pushing mechanism (including the cams 81 and the cam shaft 82) is disposed below the developing device 25, as illustrated in FIGS. 4 and 5. Such a configuration can reduce the size of the image forming unit in the horizontal direction compared with a configuration including the pushing mechanism arranged on a horizontal side of the developing device 25 (on the left side in FIG. 4). In particular, referring to FIG. 1, the image forming apparatus 1 according to the present embodiment includes four image forming units (process cartridges 20 and developing devices 25) arranged side by side in the horizontal direction. Therefore, the above-described configuration reduces a total size X of the four image forming units in the horizontal direction and can greatly reduce the size of the image forming apparatus 1.

As illustrated in FIG. 5, in the present embodiment, the base 29 has notches 29*a* (or holes) that allows the pushing mechanism (including the cams 81 and the cam shaft 82) to push the developing device main portion 26.

Specifically, the base 29 has the two notches 29*a* corresponding to rotation areas when the two cams 81 rotate from the rotational position illustrated in FIG. 4B to the rotational position illustrated in FIG. 4A so that the two cams 81 do not interfere the base 29. As a result, the pushing mechanisms (including the cams 81 and the cam shaft 82) described above can push the developing device main portion 26 and release pushing the developing device main portion 26 to rotate the developing device main portion 26.

In the present embodiment, the above-described configuration including the developing device main portion 26 in the developing device 25 rotatable between the developing position and the retracted position prevents a disadvantage such as breakage caused by the interference between the developing device 25 and the photoconductor drum 21 (the process cartridge 20) when the developing device 25 or the photoconductor drum 21 (the process cartridge 20) is installed in and removed from the body of the image forming apparatus 1.

In addition, the image forming units in the present embodiment can reduce the size in the horizontal direction (see the size X in FIG. 1) because the developing device main portion 26 rotates between the developing position and the retracted position and does not slide in the horizontal direction between the developing position and the retracted position.

The configuration in the present embodiment prevents the developing device from becoming large in size and high in cost because the pushing mechanism (including the cams 81 and the cam shaft 82) that rotates the developing device main portion 26 between the developing position and the retracted position is disposed in the body of the image forming apparatus 1 and not disposed in the developing device 25.

The following is a detailed description of operations when the operator installs the developing device 25 in the image forming apparatus 1 and removes the developing device 25 from the image forming apparatus 1.

When the operator installs the developing device 25 in the body of the image forming apparatus 1, firstly, the developing device 25 is placed so that the developing device main portion 26 is positioned at the retracted position illustrated in FIG. 4B, and the operator moves the developing device 25 in the direction indicated by arrow in FIG. to install the developing device 25 in the body of the image forming apparatus 1. The developing device 25 is moved (installed) until the two face plates 27 and 28 are positioned (fitted) to the side plates 91 and 92 of the body of the image forming apparatus 1.

After the two face plates 27 and 28 are positioned on the side plates 91 and 92 of the body of the image forming apparatus 1, the operation of the operation lever 83 causes the pushing mechanism (the cam 81) to push the developing device main portion 26 and rotate from the retracted position illustrated in FIG. 4B to the developing position illustrated in FIG. 4A. In this way, the operator completes the operation to install the developing device 25 in the body of the image forming apparatus 1.

The cover of the image forming apparatus 1 is configured so that the operation lever 83 interferes the cover not to rotate from an open position to a closed position when the developing device main portion 26 is positioned at the retracted position. The above-described configuration can prevent a disadvantage caused by performing the developing process when the developing device main portion 26 is positioned at the retracted position.

In contrast, when the operator removes the developing device 25 from the image forming apparatus 1, firstly, the pushing mechanism (the cam 81) releases pushing the developing device main portion 26 to rotate the developing device main portion from the developing position to the retracted position. After the developing device main portion 26 rotates to the retracted position, the operator removes the developing device 25 from the body of the image forming apparatus 1 and completes the operation to remove the developing device 25 from the body of the image forming apparatus 1.

As described above with reference to FIG. 2, in the present embodiment, the body of the image forming apparatus 1 includes the main body toner supply tube 71 as the supply portion having a supply port 71*a*. The supply port 71*a* communicates the replenishment port 26*d*1 of the replenishment portion 26*d* in the developing device main portion 26 of the developing device 25 and is formed to supply the toner as the developer to the developing device main portion 26 via the replenishment port 26*d*1.

Specifically, the main body toner supply tube 71 as the supply portion for each color is coupled to the toner container 70 and the developing device main portion 26 for each color. The main body toner supply tube 71 as the supply portion is a supply passage to supply the toner as the developer ejected from the toner container 70 to the developing device main portion 26. The toner is ejected from the toner container 70 to the supply port 71*a* through the main body toner supply tube 71 as the supply portion. The ejected toner is supplied to the replenishment port 26*d*1 and replenished from the replenishment port 26*d*1 to the second conveyance path B2 inside the developing device main portion 26 via the replenishment portion 26*d*.

As illustrated in FIGS. 2 and 4A, the replenishment port 26*d*1 of the developing device 25 installed in the body of the image forming apparatus 1 is positioned below (just below) the supply port 71*a*.

A toner replenishing path as a developer replenishing path in the replenishment portion 26*d* is formed to extend in a substantially vertical direction. Specifically, the replenishment portion 26*d* has a toner replenishment path surrounded by an inner wall face to guide the toner (replenishment toner) supplied from the replenishment port 26*d*1 to the second conveyance path B2. The replenishment portion 26*d* having the toner replenishment path is formed to extend in a substantially vertical direction in the developing device main portion 26 that rotates to the developing position.

Figure 6A:
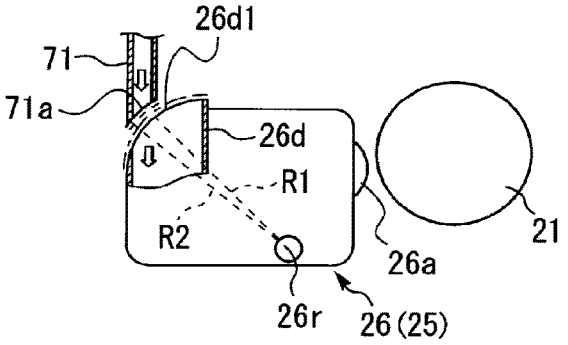
FIG. 6A is a schematic view illustrating the developing device when the developing device main portion rotates to the developing position so that a replenishment port communicates a supply port.

As illustrated by white arrows in FIGS. 2 and 6A, the above-described configuration flows the toner from the toner supply port 71*a* to the replenishment portion 26*d* via the replenishment port 26*d*1, and the toner is replenished to the second conveyance path B2 in the developing device main portion 26 by falling under the gravity and hardly touches the inner wall face. Therefore, since the toner is unlikely to adhere to the inner wall face, the above-described configuration can reduce toner clogging that occurs in the replenishment portion 26*d*.

As illustrated in FIG. 6A, in the developing device 25 according to the present embodiment, an opposite surface of the replenishment portion 26*d* and an opposite surface of the main body toner supply tube 71 as the supply portion facing each other are curved surfaces formed by arcs drawn around the rotation shaft 26*r*.

Specifically, the opposite surface of the replenishment portion 26*d* is indicated by an alternate long and short dashes line in FIG. 6A and formed to draw the arc with a radius of R1 around the rotation shaft 26*r* of the developing device main portion 26. The replenishment port 26*d*1 is formed in the opposite surface. The replenishment port 26*d*1 is opened along the arc of the opposite surface of the replenishment portion 26*d*.

Similarly, the opposite surface of the main body toner supply tube 71 as the supply portion is indicated by a dashed line in FIG. 6A and formed to draw an arc with a radius of R2 (>R1) around the rotation shaft 26*r* of the developing device main portion 26. The supply port 71*a* is formed in the opposite surface. The supply port 71*a* is opened along the arc of the opposite surface of the main body toner supply tube 71.

Figure 6B:
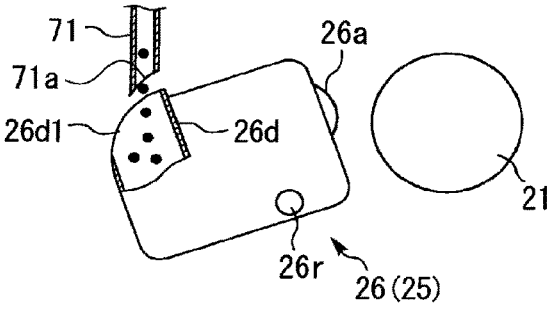
FIG. 6B is a schematic view illustrating the developing device after the developing device main portion rotates from the developing position to the retracted position.

In the above-described configuration, even when the developing device main portion 26 rotates around the rotation shaft 26*r* between the developing position illustrated in FIG. 6A and the retracted position illustrated in FIG. 6B, the replenishment portion 26*d* (the replenishment port 26*d*1) and the main body toner supply tube 71 (the supply port 71*a*) do not interfere with each other and not form a large gap (a positional deviation), and the developing device main portion smoothly rotates.

Therefore, when the developing device main portion 26 rotates to the retracted position, the above-described configuration prevents the toner from leaking to the outside from the supply port 71*a* of the main body toner supply tube 71.

In particular, in the present embodiment, the above-described configuration is useful because it is difficult to design a space for providing a shutter that closes the supply port 71*a* in conjunction with the operation of the developing device main portion 26 rotating to the retracted position. Without providing such a shutter, the above-described configuration can reduce the toner leakage from the supply port 71*a*. Therefore, the above-described configuration prevents disadvantages such as limitation of rotation of the developing device main portion 26 by the shutter, increase of the size and cost of the device.

In the present embodiment, when the replenishment portion 26*d* faces the main body toner supply tube 71 as the supply portion (when the developing device 25 is set in the body of the image forming apparatus 1), the supply port 71*a* is configured to communicate with the replenishment port 26*d*1 without coming off from the opening area of the replenishment port 26*d*1 regardless of the rotational position of the developing device main portion 26.

That is, the replenishment port 26*d*1 communicates the supply port 71*a* even when the developing device main portion 26 is located at the developing position illustrated in FIG. 6A or the retracted position illustrated in FIG. 6B and even when the developing device main portion 26 is rotating between the developing position and the retracted position.

Figure 7A:
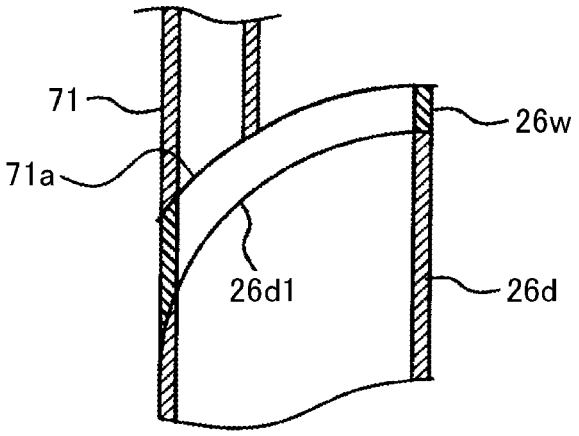
FIG. 7A is a schematic cross-sectional view illustrating a replenishment portion abutting on a supply portion via a seal.
Figure 7B:
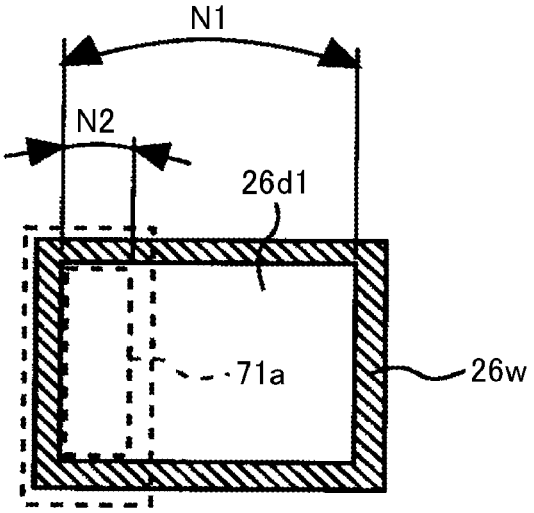
FIG. 7B is an explanatory view illustrating the replenishment port, the supply port, and the seal at the developing position as viewed from above.

Specifically, referring to FIG. 7B, a length N1 of the arc of the replenishment port 26*d*1 in the replenishment portion 26*d* is configured to be sufficiently longer than a length N2 of the arc of the supply port 71*a* in the main body toner supply tube 71 as the supply portion, that is, N1>N2.

Additionally, a length of the replenishment port 26*d*1 in a width direction that is a vertical direction in FIG. 7B is configured to be equal to or longer than a length of the supply port 71*a* in the width direction.

Figure 7C:
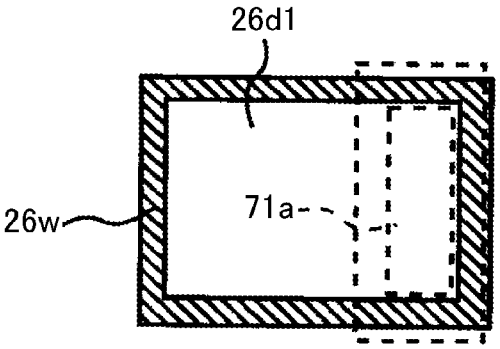
FIG. 7C is an explanatory view illustrating the replenishment port, the supply port, and the seal at the retracted position as viewed from above.

Therefore, an opening of the supply port 71*a* is positioned within an opening of the replenishment port 26*d*1 even when the developing device main portion 26 is located at the developing position illustrated in FIG. 7B or the retracted position illustrated in FIG. 7C and even when the developing device main portion 26 is rotating between the developing position and the retracted position. In other words, the supply port 71*a* is within a range of the opening of the replenishment port 26*d*1 of the developing device main portion 26 in an area from the developing position to the retracted position.

As described above, regardless of the rotational position of the developing device main portion 26, the supply port 71*a* located above the replenishment port 26*d*1 does not come off from the opening of the replenishment port 26*d*1. Therefore, toner leaks from the supply port 71*a* of the main body toner supply tube 71 to the outside is further reduced.

Particularly, when the developing device 25 is removed from the body of the image forming apparatus 1, the developing device main portion 26 rotates from the developing position illustrated in FIG. 6A to the retracted position illustrated in FIG. 6B as described above. At this time, although the toner is not intentionally supplied from the main body toner supply tube 71 to the developing device main portion 26, the toner remaining in the main body toner supply tube 71 (such as toner attached to the inner wall surface) may fall under the gravity. In the present embodiment, as illustrated in FIG. 6B, the developing device main portion 26 can receive such toner that falls under the gravity via the replenishment port 26*d*1, and the toner does not leak to the outside.

Preferably, a seal is disposed at least one of a part of the opposite surface of the replenishment portion 26*d* indicated by the alternate long and short dashes line in FIG. 6A outside of the replenishment port 26*d*1 and a part of the opposite surface of the main body toner supply tube 71 as the supply portion indicated by a dashed line in FIG. 6B outside of the supply port 71*a*.

Specifically, in the present embodiment, as illustrated in FIGS. 7A, 7B, and 7C, a seal 26*w* made of an elastic material such as foamed polyurethane is attached to a part of the opposite surface of the replenishment portion 26*d* outside of the replenishment port 26*d*1, that is, an edge portion of the replenishment port 26*d*1.

Since providing the seal 26*w* as described above prevents an occurrence of a gap between the replenishment portion 26*d* and the main body toner supply tube 71 as the supply portion, the toner leakage from the supply port 71*a* to the outside is further reduced.

Figure 8A:
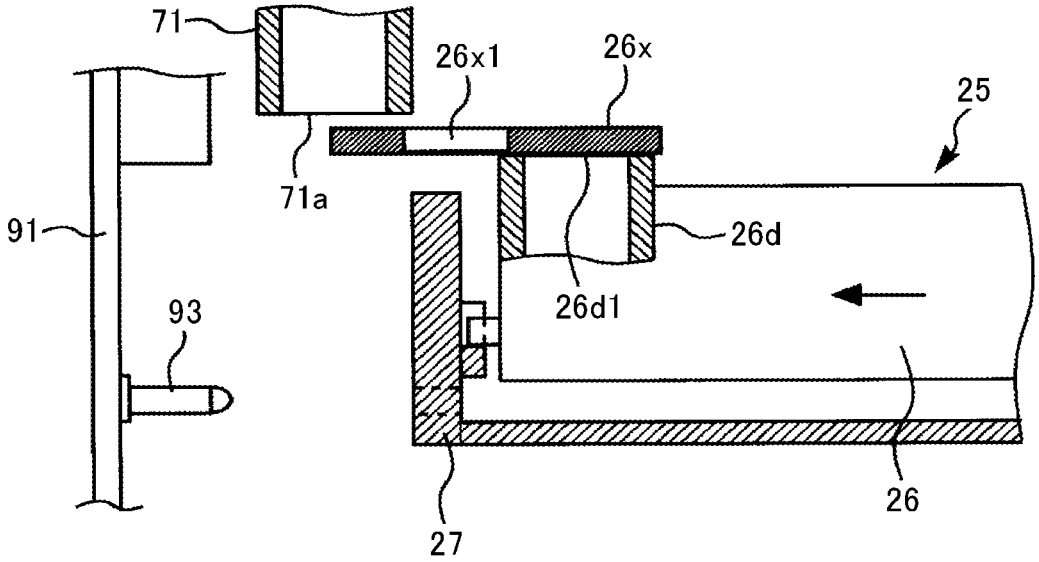
FIGS. 8A and 8B are explanatory views illustrating an operation of opening and closing a shutter in conjunction with an operation when the developing device is installed in and removed from the image forming apparatus.
Figure 8B:
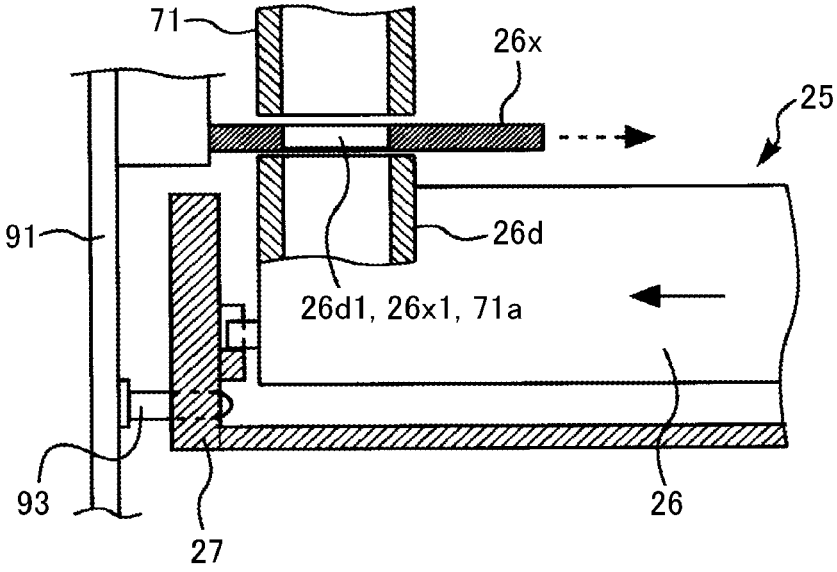

As illustrated in FIGS. 8A and 8B, in the present embodiment, a shutter 26*x* is disposed on the replenishment portion 26*d* of the developing device main portion 26 to open and close the replenishment port 26*d*1.

The shutter 26*x* opens the replenishment port 26*d*1 in conjunction with the operation to install the developing device 25 in the body of the image forming apparatus 1 and closes the replenishment port 26*d*1 in conjunction with the operation to remove the developing device 25 from the body of the image forming apparatus 1.

Specifically, the developing device main portion 26 holds the shutter 26*x* so that the shutter 26*x* can slide in the lateral direction in FIGS. 8A and 8B. In addition, the developing device main portion 26 includes a biasing member that biases the shutter 26*x* in a closing direction that is a direction toward the left side in FIGS. 8A and 8B. Therefore, as illustrated in FIG. 8A, the shutter 26*x* biased by the biasing member closes the replenishment port 26*d*1 when no external force is applied to the shutter 26*x* in an opening direction.

When the operator moves the developing device 25 in a direction indicated by arrow in FIG. 8A to install the developing device 25 in the body of the image forming apparatus 1 as illustrated in FIG. 8A, the rear side plate 91 pushes the shutter 26*x*, and the shutter 26*x* relatively moves in the opening direction that is a direction toward the right side in FIG. 8B against a biasing force of the biasing member as illustrated in FIG. 8B. When the developing device 25 is completely installed in the body of the image forming apparatus 1 as illustrated in FIG. 8B, an opening 26*x*1 formed in the shutter 26*x* matches the replenishment port 26*d*1, and the replenishment port 26*d*1 is opened.

At this time, as illustrated in FIG. 6B, the supply port 71*a* is located above the replenishment port 26*d*1 through the opening 26*x*1. In this case, the shutter 26*x* can be regarded as a part of the replenishment portion 26*d*, and in the present specification, the "opposite surface facing the supply portion on the replenishment portion 26*d*" means a part around the opening 26*x*1 of the shutter 26*x* on the opposite surface of the shutter 26*x* and the part facing a part around the supply port 71*a* on the opposite surface of the main body toner supply tube 71 as the supply portion.

After the developing device 25 is installed in the image forming apparatus 1, as described above, the developing device main portion 26 is rotated from the retracted position to the developing position, which enables the developing device main portion 26 to perform the developing process.

In removal of the developing device 25 from the body of the image forming apparatus 1, the processes are performed in reverse.

Providing the shutter 26*x* configured as described above can prevent the toner leakage from the replenishment port 26*d*1 of the developing device 25 removed from the body of the image forming apparatus 1 to the outside of the developing device 25. As illustrated in FIGS. 8A and 8B, the shutter 26*x* is opened and closed in opening and closing directions that is installation and removal directions of the developing device 25 with respect to the body of the image forming apparatus 1 and the lateral direction in FIGS. 8A and 8B. Therefore, the above-described configuration can efficiently reduce the toner that leaks from the replenishment port 26*d*1 to the outside of the developing device 25 when the developing device 25 is installed in or removed from the body of the image forming apparatus 1.

Next, a first variation is described.

Figure 9:
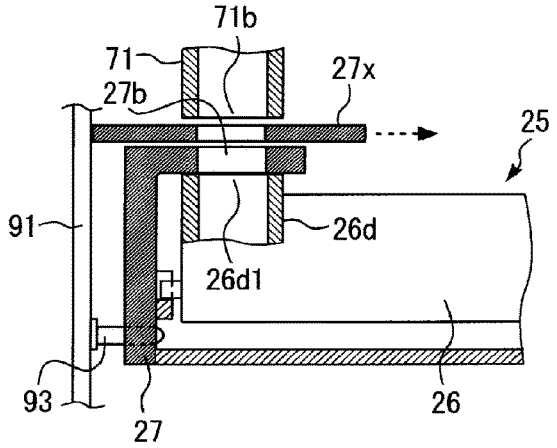
FIG. 9 is a schematic cross-sectional view illustrating a main part of the developing device and a body of the image forming apparatus in a first variation.

As illustrated in FIG. 9 and FIG. 10, a difference between the present embodiment and the first variation is that the supply portion including the supply port to communicate the replenishment port 26*d*1 and supply the toner to the developing device main portion 26 through the replenishment port 26*d*1 is disposed on the rear face plate 27 as a non-rotating portion in the developing device 25 and not disposed in the body of the image forming apparatus 1.

Specifically, a toner supply path 27*b* as a developer supply path from an inlet 27*b*1 to a supply port 27*b*2 is formed inside one of the two face plates 27 and 28, for example, the rear face plate 27, that functions as the supply portion. The toner supply path 27*b* as the developer supply path is a through hole extending in a substantially vertical direction in the rear face plate 27.

The body of the image forming apparatus 1 includes an outlet 71*b* that communicates the inlet 27*b*1 in the rear face plate 27 (as one of the two face plates) in conjunction with the operation to install the developing device 25 in the body of the image forming apparatus 1 and supplies the toner as the developer to the toner supply path 27*b* as the developer supply path in the rear face plate 27 through the inlet 27*b*1. That is, the toner ejected from the toner container 70 is ejected from the outlet 71*b* via the main body toner supply tube 71 and supplied from the replenishment port 26*d*1 to the inside of the developing device main portion 26 via the toner supply path 27*b* in the rear face plate 27. As illustrated by the white arrow in FIG. 10A, the toner falls under the gravity in a substantially vertical direction and is supplied to the developing device main portion 26.

Figure 10A:
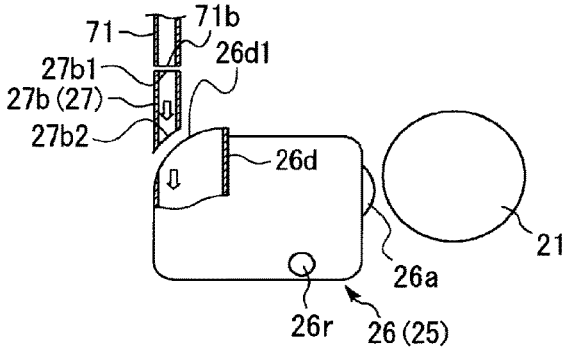
FIG. 10A is a schematic view illustrating the developing device when the developing device main portion rotates to the developing position so that the replenishment port communicates the supply port in the first variation.
Figure 10B:
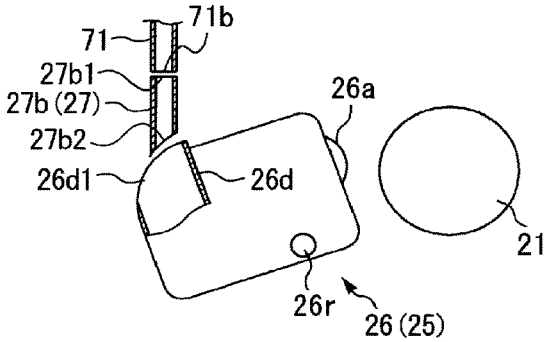
FIG. 10B is a schematic view illustrating the developing device when the developing device main portion rotates from the developing position to the retracted position in the first variation.

As illustrated in FIGS. 10A and 10B, in the first variation, the opposite surface of the replenishment portion 26*d* and the opposite surface of the rear face plate 27 as the supply portion are curved surfaces formed by substantial arcs drawn around the rotation shaft 26*r* of the developing device main portion 26 as the center. Also in the first variation, when the replenishment portion 26*d* faces the toner supply path 27*b* in the rear face plate 27 as the supply portion (when the developing device 25 is set in the body of the image forming apparatus 1), the supply port 27*b*2 is configured to communicate with the replenishment port 26*d*1 without coming off from the opening area of the replenishment port 26*d*1 regardless of the rotational position of the developing device main portion 26. Therefore, when the developing device main portion 26 rotates from the developing position to the retracted position, the above-described configuration prevents the toner from leaking to the outside from the supply port 27*b*2 that communicates the replenishment port 26*d*1 of the developing device main portion 26.

In addition, referring to FIG. 9, the developing device 25 according to the first variation includes a shutter 27*x* disposed on the rear face plate 27 (as one of the two face plates) that functions as the supply portion. The shutter 27*x* opens the inlet 27*b*1 in conjunction with the operation to install the developing device 25 in the body of the image forming apparatus 1 and closes the inlet 27*b*1 in conjunction with the operation to remove the developing device 25 from the body of the image forming apparatus 1. The shutter 27*x* is opened and closed in the opening and closing directions that is the installation and removal direction of the developing device 25 with respect to the body of the image forming apparatus 1.

As a result, similar to the present embodiment, the first variation can also prevent the toner leakage from the replenishment port 26*d*1 of the developing device 25 removed from the body of the image forming apparatus 1 to the outside of the developing device 25.

Next, a second variation is described.

Figure 11A:
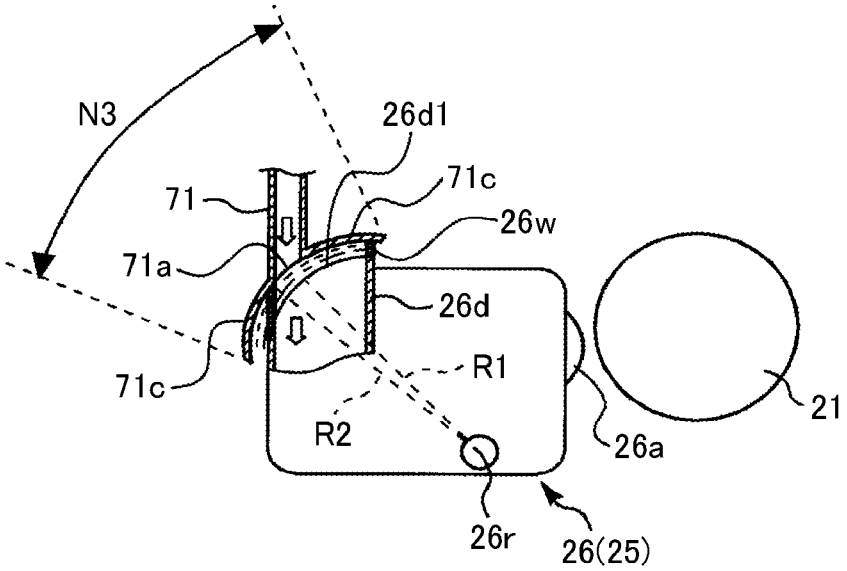
FIG. 11A is a schematic view illustrating the developing device when the developing device main portion rotates to the developing position so that the replenishment port communicates the supply port in a second variation.
Figure 11B:
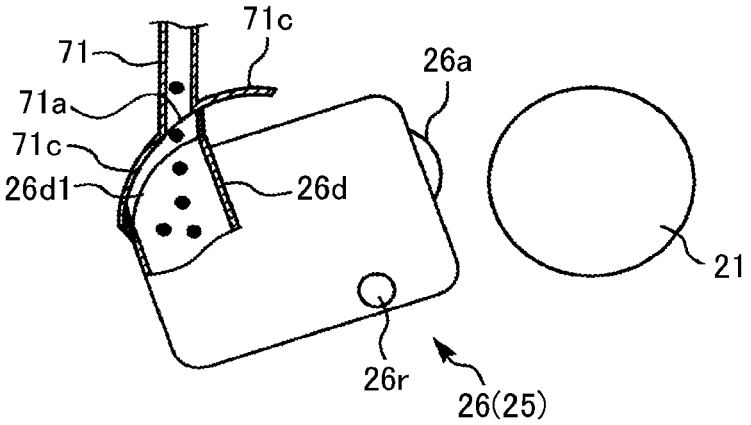
FIG. 11B is a schematic view illustrating the developing device when the developing device main portion rotates from the developing position to the retracted position in the second variation.

As illustrated in FIGS. 11A and 11B, in the second variation, a cover 71*c* is disposed at downstream end portion of the main body toner supply tube 71 as the supply portion. The cover 71*c* is formed by an arc drawn around the rotation shaft 26*r* when the developing device 25 is set in the image forming apparatus 1. That is, in the second variation, the opposite surface facing the replenishment portion 26*d* on the main body toner supply tube 71 as the supply portion has a large arc-shaped range (a length N3 of the arc) drawn around the rotation shaft 26*r*. The length N3 of the arc is set to be sufficiently longer than the length N1 of the arc of the replenishment port 23*d*1 described above with reference to FIG. 7B. The cover 71*c* covers the replenishment port 26*d*1 and does not expose the replenishment port 26*d*1 to the outside even when the developing device main portion 26 is located at the developing position illustrated in FIG. 11A or the retracted position illustrated in FIG. 11B. That is, regardless of the rotational position of the developing device main portion 26, the replenishment port 26*d*1 always communicates the supply port 71*a* and is not exposed to the outside. The above-described configuration prevents toner scattering from the replenishment port 26*d*1.

In addition, in the second variation, the seal 26*w* is attached around the replenishment port 26*d*1. The seal 26*w* slides on the cover 71*c* and prevents toner from leaking from between the replenishment portion 26*d* and the main body toner supply tube 71 when the developing device main portion 26 rotates between the developing position and the retracted position.

Preferably, the cover 71*c* is designed to have not only the arc-shaped range drawn around the rotation shaft 26*r* (the length N3 of the arc) but also a range in a width direction of the replenishment port 26*d*1 that is the range perpendicular to the sheet surface in FIGS. 11A and 11B and sufficiently larger than a range of the replenishment port 26*d*1 in the width direction so that the range of the cover 71*c* in the width direction includes the range of the replenishment port 26*d*1 in the width direction.

In the second variation, when the developing device main portion 26 rotates from the developing position to the retracted position, the above-described configuration prevents the toner from leaking to the outside from the supply port 71*a* that communicates the replenishment port 26*d*1 of the developing device main portion 26.

As described above, the developing device 25 according to the present embodiment includes the developing device main portion 26 including the developing roller 26*a* as the developer bearer that faces or contacts the photoconductor drum 21 as the image bearer and the replenishment portion 26*d* in which the replenishment port 26*d*1 is formed to replenish the toner as the developer into the developing device 25. The developing device main portion 26 is configured to be rotatable about the rotation shaft 26*r* between the developing position at which the developing roller 26*a* faces or contacts the photoconductor drum 21 and the retracted position at which the developing roller 26*a* retracts from the photoconductor drum 21. The body of the image forming apparatus 1 (or the rear face plate 27 as the non-rotating portion in the developing device 25) includes the main body toner supply tube 71 as the supply portion having the supply port 71*a* that communicates the replenishment port 26*d*1 of the replenishment portion 26*d* to replenish the toner into the developing device main portion 26 through the replenishment port 26*d*1. The opposite surface of the replenishment portion 26*d* and the opposite surface of the main body toner supply tube 71 that face each other are curved surfaces formed by substantial arcs centering on the rotation shaft 26*r*.

The above-described configuration prevents the toner from leaking to the outside from the supply port 71*a* that communicates the replenishment port 26*d*1 of the developing device main portion 26 when the developing device main portion 26 rotates from the developing position to the retracted position.

In the present embodiment, the process cartridge 20 does not include the developing device 25, and the developing device 25 is a unit that can be independently installed in and removed from the body of the image forming apparatus 1. In contrast, the developing device 25 may be one of the constituent members of the process cartridge 20, and the process cartridge 20 may be configured to be integrally installed in and removed from the body of the image forming apparatus 1. In such a case, when the developing device main portion adopts a one-component developing system using the developing roller as the developer bearer that is a contact type configured to contact the photoconductor drum as the image bearer, the configuration of the present disclosure is very useful. That is, when the developing device main portion is at the developing position at which the developing roller faces the photoconductor drum, the developing roller contacts the photoconductor drum. When the process cartridge is removed from the body of the image forming apparatus and stored for a long period of time, permanent distortion may occur in the developing roller that continuously contacts the photoconductor drum. Therefore, separating the developing roller in the developing device main portion from the photoconductor drum, that is, moving the developing roller from the developing position to the retracted position as described in the above is very useful. In such a configuration, similar effects to those of the above-described embodiment and variations are also attained.

It is to be noted that the term "process cartridge" used in the present disclosure means a removable unit including an image bearer and at least one of a charging device to charge the image bearer, a developing device to develop latent images on the image bearer, and a cleaning device to clean the image bearer that are united together, and is designed to be removably installed as a united part in the body of the image forming apparatus.

In the present embodiment according to the present disclosure, the developing device main portion 26 includes two conveying screws 26*b*1 and 26*b*2 as the conveyors horizontally arranged in parallel and the doctor blade 26*c* disposed below the developing roller 26*a*. The configuration of the developing device to which the present disclosure is applied is not limited to the above-described configurations. The present disclosure may be applied to other developing devices such as a developing device in which three or more conveyors are arranged in parallel in the horizontal direction, a developing device in which multiple conveyors are arranged in parallel in the vertical direction, and a developing device in which the doctor blade is disposed above the developing roller.

In the present embodiment according to the present disclosure, the developing device main portion 26 includes the two-component developer including toner and carrier. Alternatively, the developing device to which the present disclosure is applied may include a one-component developer (i.e., toner, which may include additives).

In the developing device 25 of the present embodiment according to the present disclosure, the toner as the developer is supplied to the replenishment portion 26*d* of the developing device main portion 26 via the supply portion that is the main body toner supply tube 71. Of course, two-component developer including toner and carrier may be supplied to the replenishment portion of the developing device main portion in the developing device to which the present disclosure is applied via the supply portion. In the above case, a developer container containing the two-component developer is used instead of the toner container 70 in the present embodiment. In those cases, the image forming apparatus also attains advantages equivalent to the advantages described above. Note that the developer bearer may be in contact with the image bearer or separate from the image bearer by the predetermined gap when the developer bearer faces the image bearer.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. Further, features of components of the embodiments, such as the number, the position, and the shape are not limited the embodiments and thus may be preferably set.

What is claimed is:

1. An image forming apparatus comprising:

an image bearer configured to bear a latent image;

a rotation shaft;

a developing device configured to be removably installed in the image forming apparatus and develop the latent image formed on the image bearer, the developing device including:

a developing device main portion configured to rotate around the rotation shaft between a developing position and a retracted position and including a developer, a developer bearer configured to face the image bearer when the developing device main portion is at the developing position and be away from the image bearer when the developing device main portion is at the retracted position, a replenishment portion having a replenishment port with an opposite surface formed by an arc drawn around the rotation shaft and configured to replenish the developer, and a non-rotating portion; and a supply portion having a supply port with an opposite surface formed by an arc drawn around the rotation shaft and facing the opposite surface of the replenishment port, the supply port configured to communicate with the replenishment port and supply the developer to the developing device main portion through the replenishment port.

2. The image forming apparatus according to claim 1, wherein the supply portion is disposed in the non-rotating portion.

3. The image forming apparatus according to claim 1, wherein the supply port communicates with the replenishment port and is not aligned out of an opening of the replenishment port regardless of a rotational position of the developing device main portion when the supply portion faces the replenishment portion.

4. The image forming apparatus according to claim 1, wherein a length of the arc of the opposite surface of the replenishment port in the replenishment portion is longer than a length of the arc of the opposite surface of the supply port in the supply portion.

5. The image forming apparatus according to claim 1, wherein the developing device includes a shutter configured to open the replenishment port in conjunction with an operation to install the developing device in the image forming apparatus and close the replenishment port in conjunction with an operation to remove the developing device from the image forming apparatus, and wherein the supply portion is disposed outside of the developing device.

6. The image forming apparatus according to claim 1, further comprising a supply tube having an outlet configured to supply the developer to the developing device, wherein the developing device includes two face plates disposed outside both ends of the developing device main portion in a longitudinal direction of the developing device main portion, and each of the two face plates is irrotationally positioned as the non-rotation portion in the image forming apparatus, and wherein one of the two face plates includes the supply portion including a developer supply path from an inlet to the supply port, the inlet configured to communicate with the outlet and receive the developer supplied when the developing device is installed in the image forming apparatus, and a shutter configured to open the inlet in conjunction with an operation to install the developing device in the image forming apparatus and close the inlet in conjunction with an operation to remove the developing device from the image forming apparatus.

7. The image forming apparatus according to claim 5, wherein opening and closing directions of the shutter are installation and removal directions of the developing device with respect to the image forming apparatus.

8. The image forming apparatus according to claim 1, further comprising a seal disposed on at least one of a part of the opposite surface of the replenishment portion outside of the replenishment port and a part of the opposite surface of the supply portion outside of the supply port.

9. The image forming apparatus according to claim 1, wherein the replenishment portion includes the replenishment port disposed under the supply port and a developer replenishing path extending in a vertical direction.

10. The image forming apparatus according to claim 1, wherein the developing device and the image bearer are integrated as a process cartridge configured to be removably installed in the image forming apparatus.

11. A developing device configured to be removably installed in an image forming apparatus including an image bearer, a rotation shaft, and a supply port to supply developer to the developing device, comprising:

a developing device main portion configured to rotate around the rotation shaft between a developing position and a retracted position and including the developer, a developer bearer configured to face the image bearer when the developing device main portion is at the developing position and be away from the image bearer when the developing device main portion is at the retracted position, a replenishment portion having a replenishment port with an opposite surface formed by an arc drawn around the rotation shaft and configured to replenish the developer, and a non-rotating portion.

12. The developing device according to claim 11, wherein an opening of the replenishment port is configured to communicate with the supply port when the developing device main portion is in an area from the developing position to the retracted position.

13. The developing device according to claim 11, wherein a length of the arc of the opposite surface of the replenishment port in the replenishment portion is longer than a length of the supply port in a rotation direction of the developing device main portion.

14. The developing device according to claim 11, further comprising a seal disposed on a part of the opposite surface of the replenishment portion outside of the replenishment port.

15. The developing device according to claim 11, wherein the replenishment portion includes a developer replenishing path extending in a vertical direction, and the replenishment port is disposed under the supply port when the developing device is installed in the image forming apparatus.

16. The image forming apparatus according to claim 1, further comprising a supply tube having an outlet configured to supply the developer to the developing device, wherein the developing device includes two face plates disposed outside both ends of the developing device main portion in a longitudinal direction of the developing device main portion, and each of the two face plates is irrotationally positioned as the non-rotation portion in the image forming apparatus.

17. The image forming apparatus according to claim 1, further comprising a supply tube having an outlet configured to supply the developer to the developing device, wherein the developing device includes two face plates disposed outside both ends of the developing device main portion in a longitudinal direction of the developing device main portion, and each of the two face plates is irrotationally positioned as the non-rotation portion in the image forming apparatus, and wherein one of the two face plates includes the supply portion including a developer supply path from an inlet to the supply port, the inlet configured to communicate with the outlet and receive the developer supplied when the developing device is installed in the image forming apparatus.

18. The image forming apparatus according to claim 1, wherein the supply portion is a supply tube.

* * * * *